US009169704B2

(12) United States Patent
Dockweiler et al.

(10) Patent No.: US 9,169,704 B2
(45) Date of Patent: Oct. 27, 2015

(54) EXPANDABLE WEDGE SLIP FOR ANCHORING DOWNHOLE TOOLS

(71) Applicant: HALLIBURTON ENERGY SERVICES, INC., Carrollton, TX (US)

(72) Inventors: David Allen Dockweiler, McKinney, TX (US); Anthony Valencia, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 392 days.

(21) Appl. No.: 13/756,281

(22) Filed: Jan. 31, 2013

(65) Prior Publication Data

US 2014/0209325 A1 Jul. 31, 2014

(51) Int. Cl.

| | |
|---|---|
| ***E21B 33/12*** | (2006.01) |
| ***E21B 23/01*** | (2006.01) |
| ***E21B 33/129*** | (2006.01) |

(52) U.S. Cl.

CPC ..... *E21B 23/01* (2013.01); *E21B 33/129* (2013.01)

(58) Field of Classification Search

USPC ..... 166/382, 387, 118, 134, 135, 138, 140, 166/179, 217

See application file for complete search history.

(56) References Cited

U.S. PATENT DOCUMENTS

| | | | | |
|---|---|---|---|---|
| 3,860,067 | A * | 1/1975 | Rodgers | 166/121 |
| 4,253,521 | A | 3/1981 | Savage | |
| 4,773,478 | A | 9/1988 | Streich | |
| 5,178,219 | A * | 1/1993 | Striech et al. | 166/289 |
| 5,701,959 | A | 12/1997 | Hushbeck et al. | |
| 6,021,850 | A | 2/2000 | Wood | |
| 6,029,748 | A | 2/2000 | Forsyth | |
| 6,712,153 | B2 | 3/2004 | Turley et al. | |
| 6,769,491 | B2 | 8/2004 | Zimmerman et al. | |
| 7,124,831 | B2 | 10/2006 | Turley et al. | |
| 7,779,927 | B2 | 8/2010 | Turley et al. | |
| 7,779,928 | B2 | 8/2010 | Turley et al. | |
| 7,789,135 | B2 | 9/2010 | Turley et al. | |
| 7,789,136 | B2 | 9/2010 | Turley et al. | |
| 7,789,137 | B2 | 9/2010 | Turley et al. | |
| 7,845,421 | B2 | 12/2010 | Braddick | |
| 8,066,065 | B2 | 11/2011 | Buckner | |
| 8,100,188 | B2 | 1/2012 | Watson | |
| 8,132,627 | B2 | 3/2012 | Braddick | |
| 2003/0226660 | A1 | 12/2003 | Winslow et al. | |
| 2003/0226668 | A1 * | 12/2003 | Zimmerman et al. | 166/387 |

(Continued)

FOREIGN PATENT DOCUMENTS

| | | | |
|---|---|---|---|
| CA | 2200257 | C | 1/2004 |
| EP | 0798445 | A3 | 5/2001 |

(Continued)

OTHER PUBLICATIONS

International Search Report and Written Opinion of the International Searching Authority dated Apr. 22, 2014, filed in corresponding PCT Application No. PCT/US2014/010653.

*Primary Examiner* — Sean Andrish
(74) *Attorney, Agent, or Firm* — McAfee & Taft

(57) ABSTRACT

An expansion apparatus for anchoring a downhole tool in a well is provided. The expansion apparatus has a wedge, an expansion wedge and a slip ring. The wedge and expansion wedge interact so as to radially expand wedge segments of the expansion wedge. The slip ring and expansion wedge interact so as to radially expand the slip ring to grippingly engage the wellbore or casing.

18 Claims, 7 Drawing Sheets

(56) References Cited

U.S. PATENT DOCUMENTS

| | | | |
|---|---|---|---|
| 2004/0177952 | A1 | 9/2004 | Turley et al. |
| 2007/0039160 | A1 | 2/2007 | Turley et al. |
| 2008/0277111 | A1 | 11/2008 | Braddick |
| 2009/0038790 | A1 | 2/2009 | Barlow |
| 2009/0242213 | A1 | 10/2009 | Braddick |
| 2010/0218879 | A1 | 9/2010 | Turley et al. |
| 2010/0288487 | A1 | 11/2010 | Turley et al. |
| 2010/0288488 | A1 | 11/2010 | Turley et al. |
| 2010/0288508 | A1 | 11/2010 | Turley et al. |
| 2010/0288513 | A1 | 11/2010 | Turley et al. |
| 2010/0294483 | A1 | 11/2010 | Turley et al. |
| 2011/0079383 | A1 | 4/2011 | Porter |
| 2011/0259607 | A1 | 10/2011 | Carisella |
| 2012/0255723 | A1 | 10/2012 | Standridge |

FOREIGN PATENT DOCUMENTS

| | | | |
|---|---|---|---|
| EP | 0798445 | B1 | 6/2003 |
| EP | 2273065 | | 12/2011 |
| WO | 03002847 | A1 | 1/2003 |
| WO | 03104610 | A1 | 12/2003 |
| WO | 2012136960 | A2 | 10/2012 |
| WO | 2012136960 | A3 | 3/2013 |

* cited by examiner

EXPANDABLE WEDGE SLIP FOR ANCHORING DOWNHOLE TOOLS

BACKGROUND OF THE INVENTION

1. Field of the Invention

This invention generally relates to tools used in oil and gas wellbores. More specifically, the disclosure relates to expansion apparatuses used to anchor downhole tools in wellbores.

2. Description of Related Art

In drilling or reworking of oil wells, a great variety of downhole tools are used. Such downhole tools often have to be anchored within the wellbore for proper operation. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Among other tools, packers are designed for these general purposes. Packers use an expandable sealing element to seal the tubing; however, these elements cannot generally provide sufficient anchorage to prevent lifting of the tubing. Typically, packers have thus relied on slip rings which expand to grippingly engage the wall to anchor the tubing. Additionally, anchoring is needed for application of other downhole tools within the wellbore.

Problems are encountered in anchoring downhole tools because of variation in wellbore or casing diameter. Thus, an anchor that adequately expands for one size casing might be too small for a larger size casing or too large to fit into a smaller casing. This can be especially problematic where a downhole tool must be lowered through the smaller casing and anchored in a larger casing below the smaller casing.

Thus, while there are a number of anchoring apparatuses available, there is a need for further such apparatus that can meet the needs of different well operations utilizing different casing sizes.

SUMMARY OF THE INVENTION

According to one embodiment of the invention there is provided an expansion apparatus for a downhole tool, comprising a wedge, an expandable wedge and a plurality of slip segments. The wedge has an inclined outer wall and is coaxial to a central axis. The expandable wedge has wedge segments. The wedge segments comprise an inner surface and an inclined outer surface. The wedge segments are disposed about the central axis. The wedge segments move radially outward by interaction with the wedge. The plurality of slip segments are disposed about the central axis and expandable radially outward by interaction with the expandable wedge.

According to another embodiment there is provided a downhole tool for use in a well comprising a mandrel, a wedge, an expandable wedge and a slip ring. The wedge is disposed about the mandrel and is coaxial with said mandrel to a central axis. The expandable wedge has wedge segments disposed about the mandrel and, when the downhole tool moves from an unset position to a set position, the wedge segments expand radially outwardly by interaction with the wedge. The slip ring is disposed about the mandrel and, when the downhole tool moves from an unset position to a set position, the slip ring expands radially outward by interaction with said expandable wedge so that the slip ring grippingly engages the well.

In a further embodiment there is provided a method of operating a wellbore servicing tool, comprising:

longitudinally compressing an expansion device along a central axis such that a wedge, a plurality of expandable wedge segments and a slip ring comprising a plurality of slip segments wherein there is relative axial movement of the wedge, expandable wedge and slip ring towards each other during the longitudinal compression; and upon sufficient compression, expanding the plurality of expandable wedge segments radially outward by interaction of the wedge with the plurality of expandable wedge segments and expanding the plurality of slip segments radially outward by interaction of the slip ring with the plurality of expandable wedge segments.

BRIEF DESCRIPTION OF THE DRAWINGS

FIG. 6 is a partial sectional view of the downhole tool of FIG. 5 shown in its set position.

DESCRIPTION OF THE PREFERRED EMBODIMENTS

Figure 1:
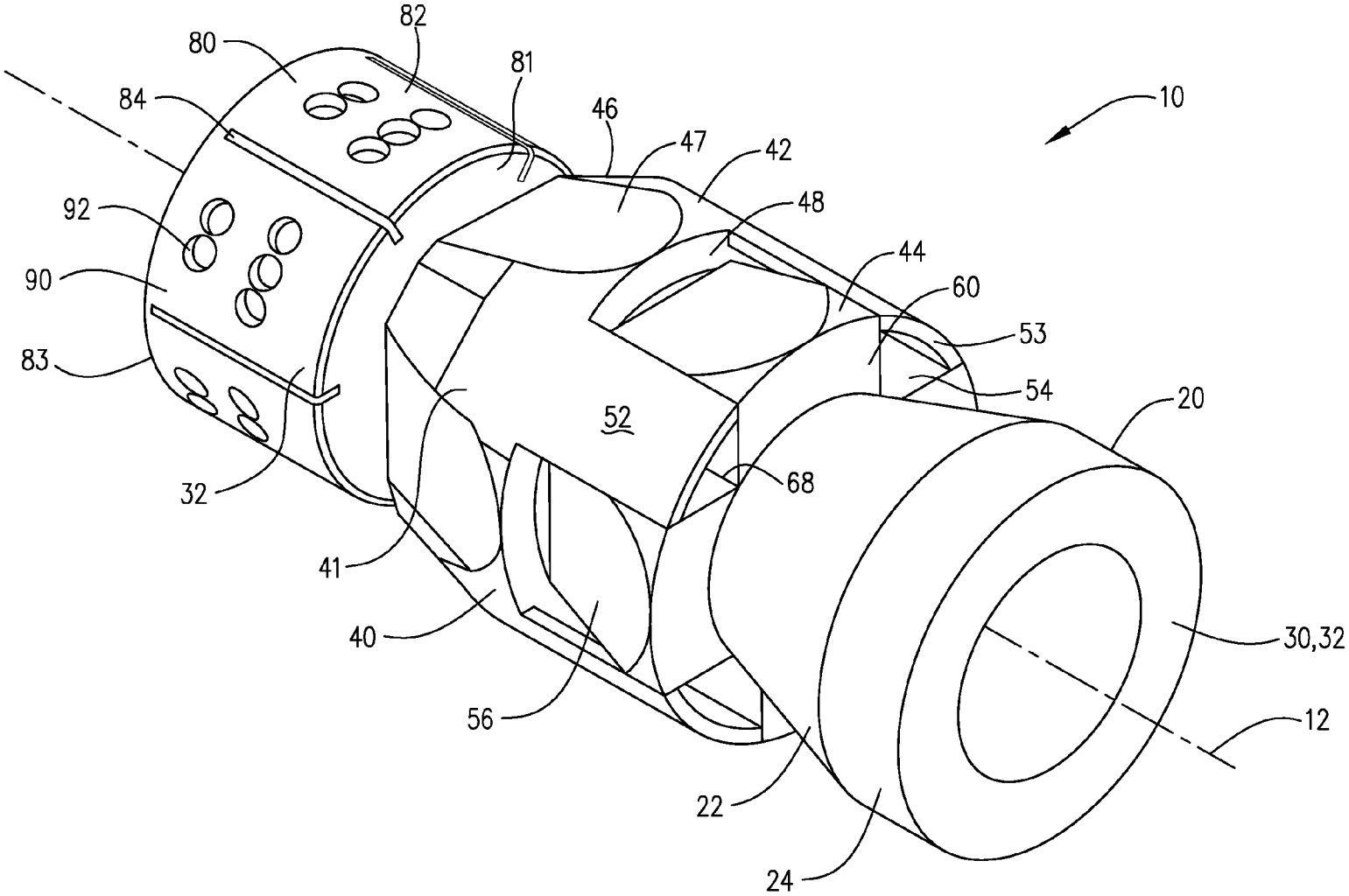
FIG. 1 is an oblique perspective view of an expansion device with a slip ring in accordance with one embodiment of the current invention. The expansion device of FIG. 1 is in its run-in configuration or unset position.

In the drawings and description that follow, like parts are typically marked throughout the specification and drawings with the same reference numerals, respectively. The figures are not necessarily to scale. Certain features of the invention may be shown exaggerated in scale or in somewhat schematic form and some details of conventional elements may not be shown in the interest of clarity and conciseness.

Figure 2:
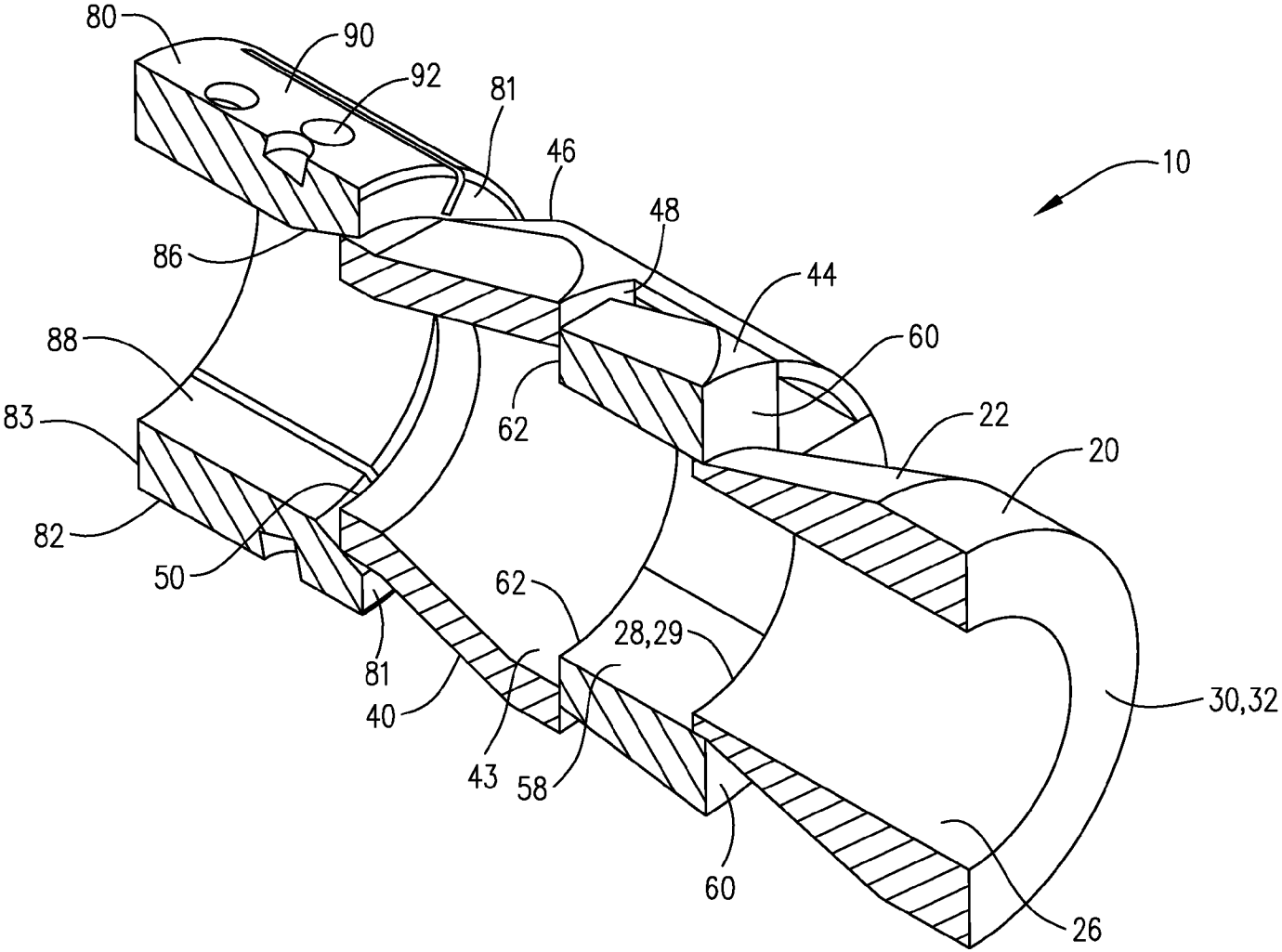
FIG. 2 is an oblique cross-sectional view of the expansion device of FIG. 1.
Figure 3:
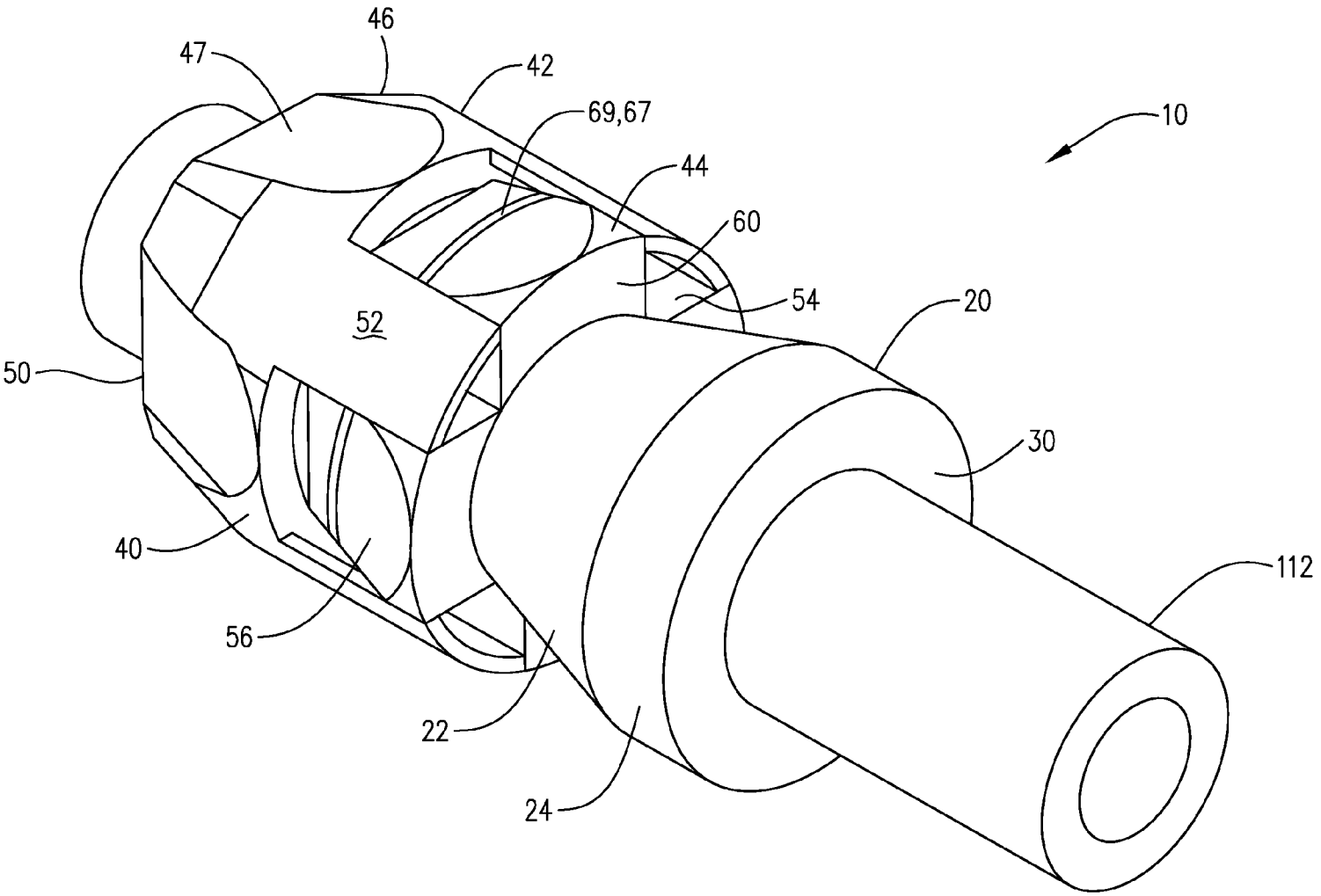
FIG. 3 is an oblique perspective view of an expansion device in accordance with another embodiment of the current invention shown without the slip ring. The expansion device of FIG. 3 is in its run-in configuration.
Figure 4:
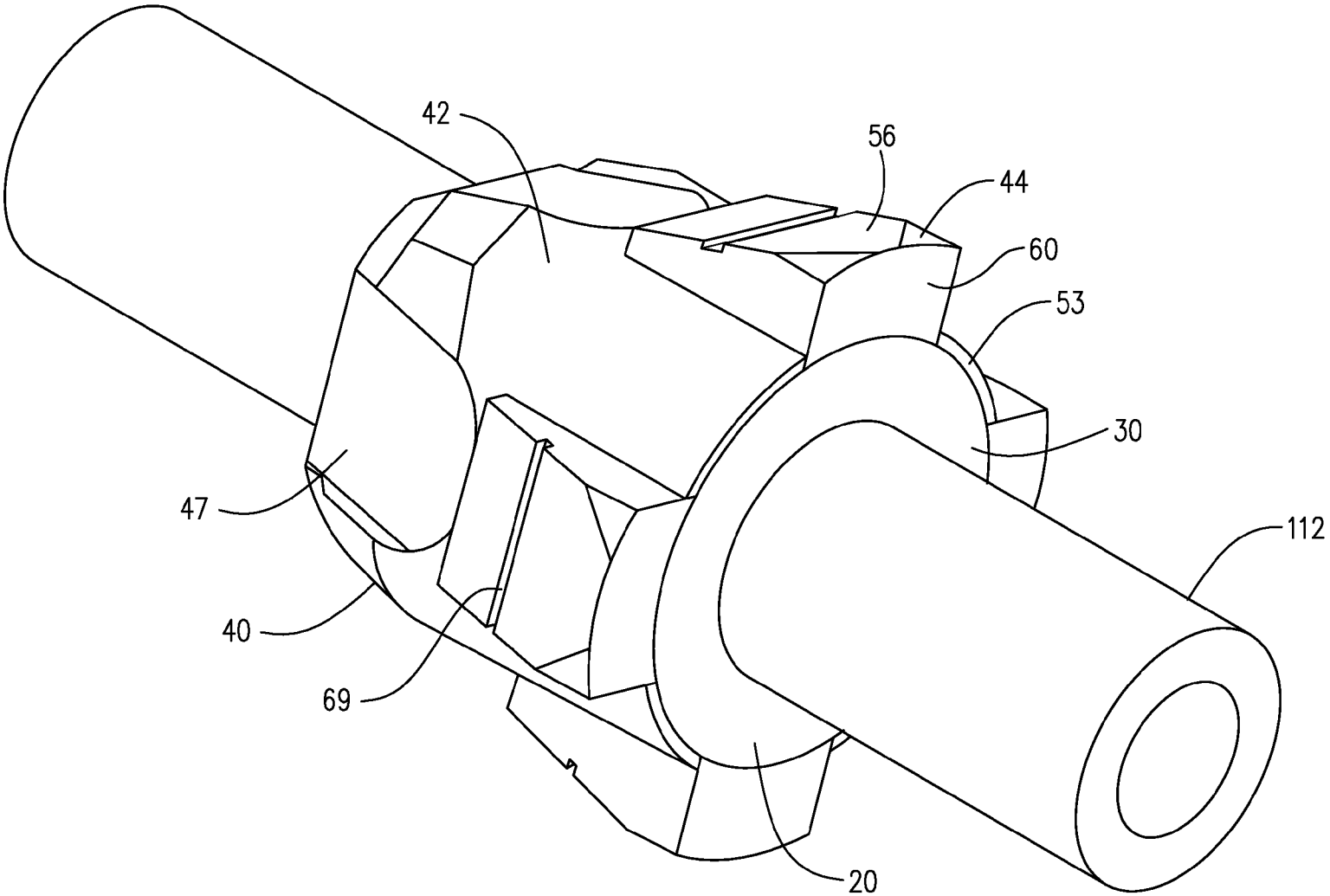
FIG. 4 is an oblique perspective view of the expansion device of FIG. 3 shown in its expanded configuration or set position.
Figure 7:
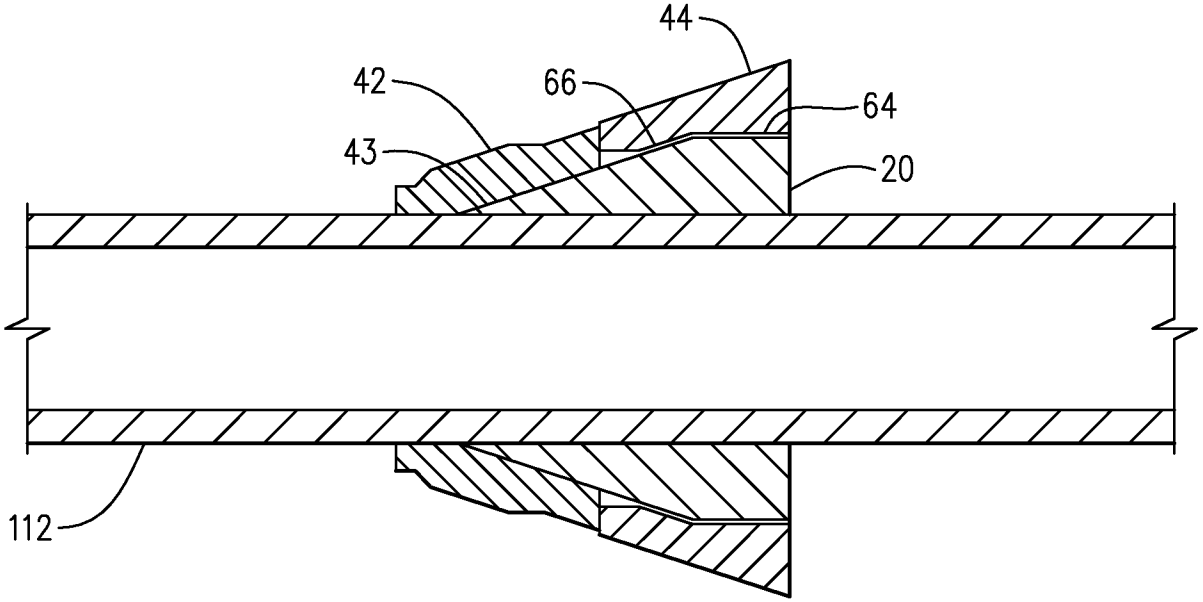
FIG. 7 is a side sectional view of the expansion device of FIG. 4 in the expanded configuration.

Referring now to FIGS. 1-4 and 7, FIG. 1 is an oblique perspective view of an expansion device or apparatus 10 having a central axis 12 including a wedge 20 and expansion wedge 40 and a slip ring 80 according to one embodiment of the current invention. FIG. 2 is an oblique cross-sectional view of the expansion device of FIG. 1. The expansion device 10 in FIGS. 1 and 2 is in its run-in configuration or unset position; that is, in the configuration for introduction into the well. FIGS. 3 and 4 show an oblique perspective view of an expansion device in accordance with another embodiment of the current invention. The embodiments of FIGS. 3 and 4 are shown without the slip ring and, thus, have wedge 20 and expansion wedge 40. Additionally, the expansion device 10 of FIGS. 3 and 4 is shown on mandrel 112. FIG. 3 is in the run-in configuration and FIG. 4 is in the expanded configuration or unset position. FIG. 7 is a side sectional view of the expansion device of FIG. 4.

Focusing now mainly on FIGS. 1 and 2, wedge 20 comprises an inclined outer wall or inclined outer surface 22 and an annular wedge base 24. Inclined outer wall 22 is shown as a generally frustoconical wall with annular wedge base 24 forming a base of the frustoconical shape; however inclined outer wall 22 can have other configurations such as adjoining incline planes (see FIG. 6). It will be appreciated that while the inclined outer wall 22 and annular wedge base 24 are described as separate geometric structures, in this embodiment, inclined outer wall 22 and annular wedge base 24 are formed integrally. Wedge 20 further comprises an inner surface or inner wall 26, which is configured to accept a mandrel coaxially therein and, hence, generally will define a space that is substantially cylindrical in shape. Generally, wedge 20 will be attached to the mandrel, such as by pins, but can be integrally formed as a part of the mandrel. As will be appreciated from FIG. 2, wedge 20 terminates at a first end 28 at a conical tip 29, which is the narrowest part of wedge 20, and at a second end 30, which is the end wall 32 of annular wedge base 24.

Expansion wedge 40 comprises a collar piece 42 and wedge segments 44. Collar piece 42 has an outer surface 41 and an inner surface 43. Collar piece 42 generally comprises a first portion or inclined portion 46 and a second portion, which comprises a plurality of axially extending members 52. Inclined portion 46 can comprise a frustoconical wall or, as shown, can be composed of adjoining incline planes 47, which form roughly a conical shape. Inclined portion 46 has a first end 48 and second end 50. Axially extending members 52 join with inclined portion 46 at first end 48 and extend axially towards wedge 20. Axially extending members 52 have a terminus end 53. As can be seen from FIG. 3, axially extending members 52 are coaxial to but radially outer from the mandrel 112; thus in the run-in configuration, a gap 54 is formed between the axially extending members 52 and the mandrel 112 and/or the conical tip 29 of wedge 20. As can be seen from FIG. 4, this gap is at least partially filled by wedge 20 when expansion device 10 is in the expanded configuration such that axially extending members 52 are in contact with annular wedge base 24 at terminus end 53.

Located between axially extending members 52 are wedge segments 44. Wedge segments 44 have an inclined outer surface 56. Wedge segments 44 are configured such that they do not extend radially outward from collar piece 42 when the expansion device is in the run-in configuration and, when the expansion device is in the expanded configuration, they are moved outward by wedge 20 so that they extend radially outward from collar piece 42. Thus, in the set position wedge segments 44, together with collar piece 42, form a continuous wedge. In the embodiment illustrated in FIGS. 1 and 2, wedge segments 44 have an inclined outer surface 56, an inner surface 58, a first end surface 60 and a second end surface 62. As can be seen from FIG. 7, inner surface 58 can have an annular portion 64 and an inclined portion 66. In the run-in configuration, conical tip 29 is radially underneath annular portion 64, as can be seen from FIG. 2. In the expanded configuration, annular wedge base 24 is radially underneath annular portion 64, as can best be seen from FIG. 7.

Wedge segments 44 are frangibly connected to each other in the run-in configuration and separate from each other in the expanded configuration. Wedge segments 44 can be connected at seam 68 by a thin seam of material designed to break upon exertion of axial pressure for wedge 20 produced by longitudinal compression of expansion apparatus 10 along central axis 12. Alternatively, wedge segments 44 can be connected by a retaining band 67 located in groove 69 as seen in FIGS. 3 and 4. Retaining band 67 is designed to break upon exertion of radial pressure created by interaction of wedge 20 and wedge segments 44 during the longitudinal compression of expansion apparatus 10. Other alternative means of frangible connection will be readily seen by those skilled in the art based on the disclosure herein.

As shown in FIGS. 1 and 2, slip ring 80 is comprised of slip segments 82, which, collectively, are generally configured as angular segments of a substantially cylindrical tube. Slip segments 82 are frangibly connected by a seam 84, or by a retaining band 85 (see FIG. 5), or by other means known in the art such as by bonding adjacent slip segments 82 at seam 84 with an adhesive material such as, for example, nitrile rubber. In this embodiment, an angular array of eight slip segments 82 are disposed equidistant from the central axis 12 and parallel to the central axis 12. Each slip segment 82 comprises first end 81, second end 83, outer surface 90 and inner surface 88. Inner surface 88 has an inclined surface 86 formed as a recessed portion of an inner surface 88 of the slip segment 82. The inclined surface 86 is formed as a generally frustoconical incline segment having an incline angle complementary to an incline angle of the inclined portion 46 of collar piece 42. In the run-in configuration, first end 50 of collar piece 42 is radially underneath inclined surface 86 as can be seen from FIG. 2. In the set position, wedge segments 44 are radially underneath slip segments 82, which have separated as can best be seen from FIG. 6.

Each slip segment 82 additionally comprises an outer surface 90 which has a plurality of receptacles 92 configured to receive complementary shaped tooth buttons 169 (see FIGS. 5 and 6) that extend from the receptacles 92 to engage the casing or wellbore when the slip segments 82 are in an expanded configuration. Alternatively, the receptacles 92 may receive mounting posts of tooth plate assemblies, as are known in the art, for similarly engaging the casing when the slip segments 82 are in an expanded configuration. In alternative embodiments, teeth or other protruding elements may be formed integrally with the slip segments 50. It will be appreciated that whatever such elements are used, the radially outer most portions of those elements may need to be limited so as not to engage the wellbore or casing prior to being placed into the expanded configuration.

As can be seen from FIGS. 1 and 2, in the run-in configuration, wedge segments 44 are frangibly connected and slip segments 82 are frangibly connected. Inclined surface 86 of the slip segments 82 and second end 50 of the collar piece 42 overlap with second end 50 being radially inward from inclined surface 86. Additionally, wedge segments 44 overlap conical tip 29 so that conical tip 29 is radially inward from wedge segments 44. In order to change the configuration from the run-in configuration to the expanded configuration, a predetermined longitudinal pressure is applied such that there is axial movement of the wedge 20, expansion wedge 40 and slip ring 80 relative to one another and towards one another. This can mean that all three elements move relative to a mandrel on which they are installed or one of the elements, typically wedge 20, can be anchored to the mandrel and the other two elements will move relative to the mandrel. Thus, for example, wedge 20 may be anchored by pins or may be formed as part of the mandrel, as illustrated in FIGS. 3, 4 and 7, with expansion wedge 40 and slip ring 80 being allowed to move along the mandrel. Expansion wedge 40 and slip ring 80 may be attached to the mandrel by shear pins in order to prevent movement prior to applying the predetermined longitudinal pressure necessary for shearing the pins. During the relative movement of the elements, wedge 20 serves as a wedge to separated wedge segments 44 and to move wedge segments 44 radially outward. The collar piece 42 serves as a wedge to separate slip segments 82 and move slip segments 82 radially outward. Subsequently, slip segments 82 will move further radially outward by wedge segments 44, which serve as a wedge for the further outward movement of slip segments 82 and to place the tooth buttons 169, retained in receptacles 92, in contact with the casing. Accordingly, as can be seen from FIGS. 1-4, collar piece 42 provides expansion of the slip ring to a radius approximately equal to a conventional wedge and wedge segments 44 provide for expansion of the slip ring to an even greater radius than a conventional wedge.

Figure 5:
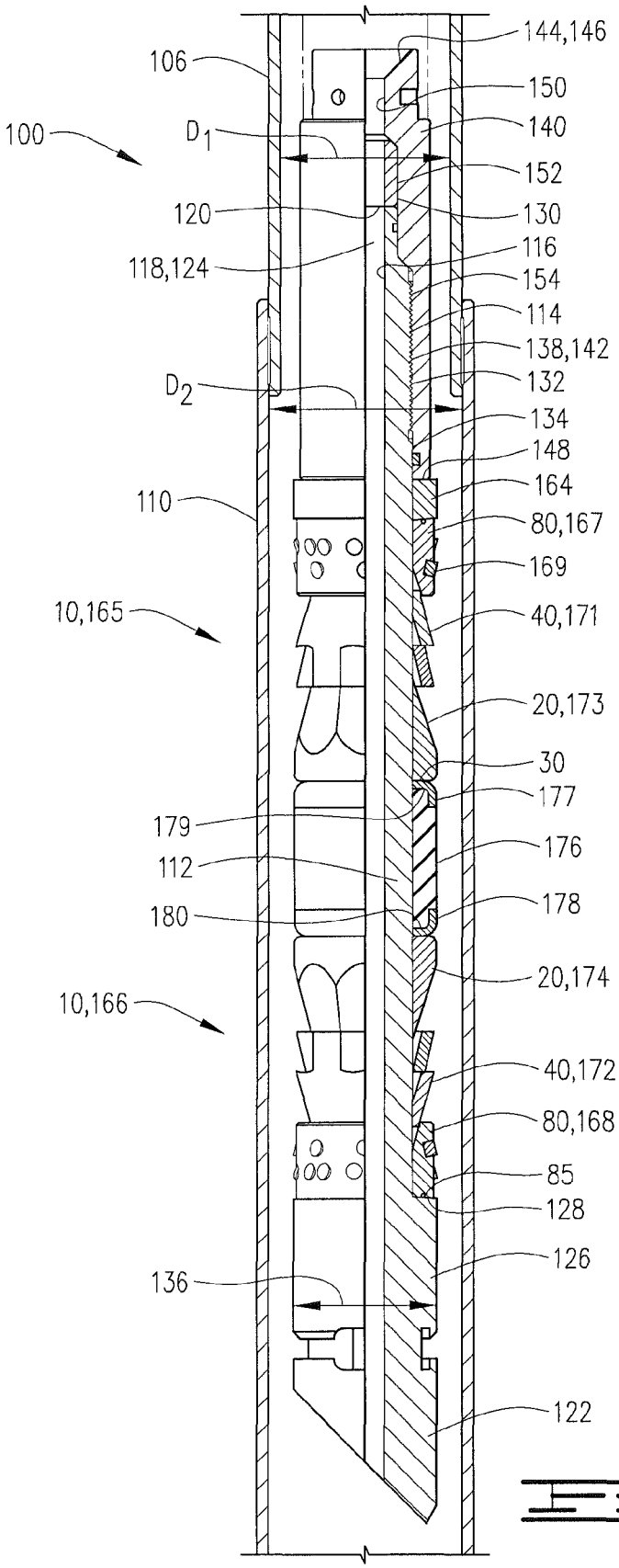
FIG. 5. is a partial section view showing an embodiment of the expansion device used in a downhole tool. The downhole tool is in its unset position.
Figure 5:
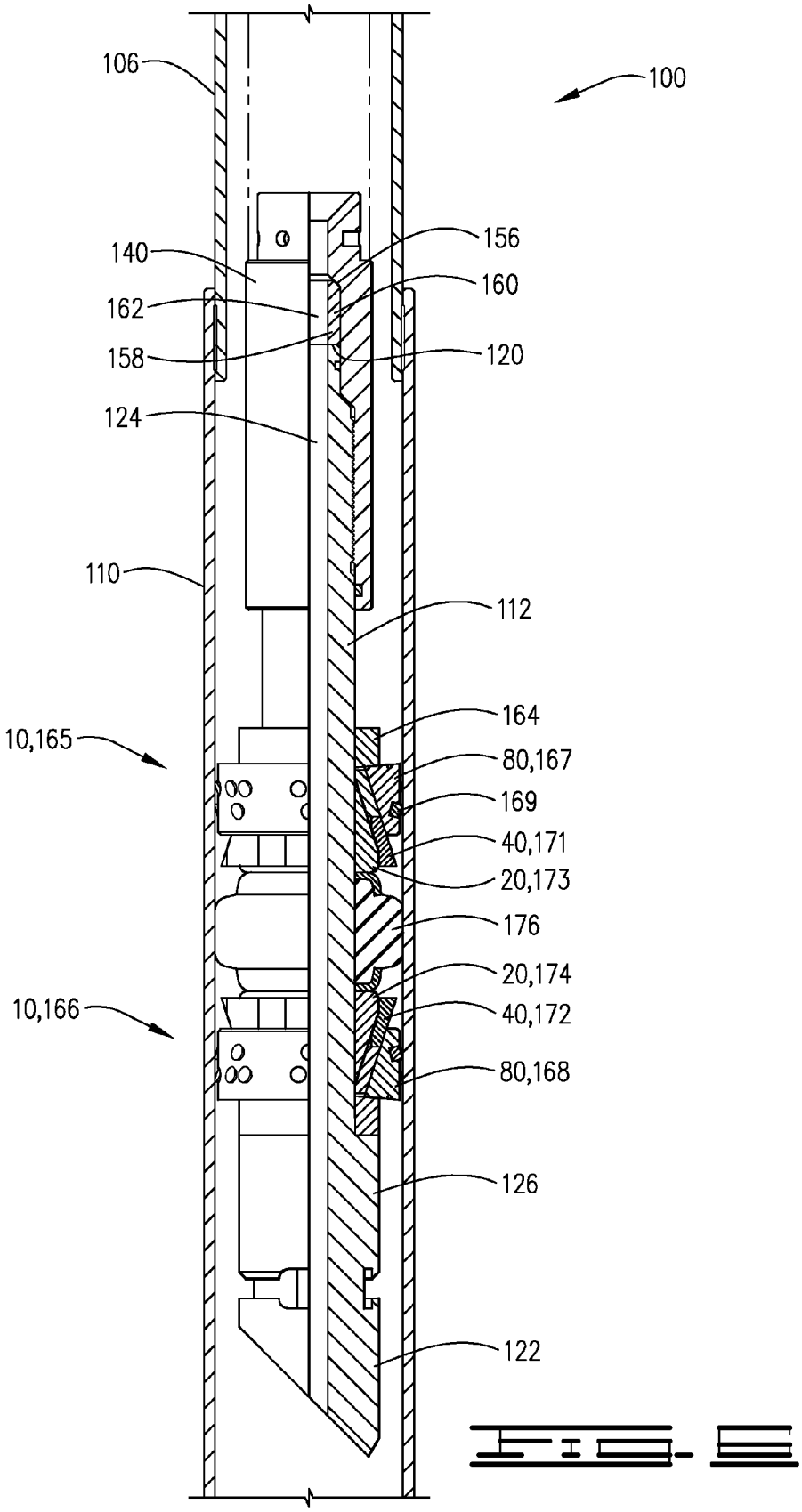

Turning now to FIGS. 5 and 6, the use of the invention in a downhole tool 100 is shown. While the embodiment of FIGS. 5 and 6 illustrate downhole tool 100 as a packer tool, it should be understood that the invention is not limited to use in packer type tools but is useful for any downhole tool that requires anchoring or stabilization within the wellbore and is especially useful where there is a change in wellbore diameter such that the tool and expansion device must pass through a wellbore of smaller radius before being received into the wellbore where it will be placed in the set position, the latter wellbore having a greater radius than the wellbore of smaller radius.

Accordingly, in FIGS. 5 and 6, downhole tool 100 is shown in a well comprising first wellbore or first casing 106 having a diameter $D_1$ and a second wellbore or second casing 110 having a diameter $D_2$. As can be seen, $D_1$ is less than $D_2$. Downhole tool 100 can be lowered into a well on tubing or can be lowered on a wire line or other means known in the art (not shown). FIG. 5 shows the downhole tool 100 in its unset position and FIG. 6 shows downhole tool 100 in its set position.

Downhole tool 100 comprises a mandrel 112 with an outer surface 114 and inner surface 116. Mandrel 112 will typically be a drillable material such as a polymeric composite. Mandrel 112 has a bore 118 defined by inner surface 116. Mandrel 112 has upper or top end 120 and lower or bottom end 122. Bore 118 defines a central flow passage 124 therethrough. An end section 126 may comprise a mule shoe 126. Mule shoe 126 is shown as integrally formed with the mandrel 112 but can be a separate piece that is connected with pins to mandrel 112. Mule shoe 126 defines an upward facing shoulder 128 thereon.

Mandrel 112 has first or upper outer diameter 130, a second or first intermediate outer diameter 132, which is a threaded outer diameter 132, a third or second intermediate outer diameter 134 and a fourth or lower outer diameter 136. Shoulder 128 is defined by and extends between third and fourth outer diameters 134 and 136, respectively. Threads 138 are defined on threaded outer diameter 132. A head or head portion 140 is threadedly connected to mandrel 112 and, thus, has mating buttress threads 142 thereon.

Head portion 140 has an upper end 144 that may comprise a plug or ball seat 146. Head 140 has lower end 148 and has first, second and third inner diameters 150, 152 and 154, respectively. Buttress threads 142 are defined on third inner diameter 154. Second inner diameter 152 has a magnitude greater than first inner diameter 150 and third inner diameter 154 has a magnitude greater than second inner diameter 152. A shoulder 156 is defined by and extends between first and second inner diameters 150 and 152. Shoulder 156 and upper end 120 of mandrel 112 define an annular space 158 therebetween. In the embodiment illustrated, a spacer sleeve 160 is disposed in annular space 158. Spacer sleeve 160 has an open bore 162 so that fluid may pass unobstructed therethrough into and through longitudinal central flow passage 124. Head portion 140 may be disconnected by unthreading from mandrel 112 so that instead of spacer sleeve 160, a plug may be utilized. The plug will prevent flow in either direction and as such the tool will act as a bridge plug.

A spacer ring 164 is disposed about mandrel 112 and buts lower end 148 of head portion 140 so that it is axially restrained on mandrel 112. Downhole tool 100 further comprises a set of expansion apparatuses 10 as described above. Expansion apparatuses 10 comprise first and second or upper and lower expansion apparatuses 165 and 166. Upper and lower expansion apparatuses 165 and 166 are generally identical in configuration but their orientation is reversed on mandrel 112. Expansion apparatuses 165 and 166 have a slip ring 80, first and second, or upper and lower slip rings 167 and 168, respectively, which are in accordance with the discussion above. Slip rings 80 are shown as having buttons 169 secured to the outer surface thereof. When downhole tool 100 is moved to the set position, as shown in FIG. 6, buttons 169 will grippingly engage second casing 110 to secure downhole tool 100 in well 102. Buttons 169 comprise a material of sufficient hardness to partially penetrate second casing 110 and may be comprised of metallic-ceramic composite or other material of sufficient strength. Expansion apparatuses 165 and 166 further have expansion wedges 40, which comprise first and second, or upper and lower expansion wedges 171 and 172, respectively. Expansion wedges 171 and 172 are likewise disposed about mandrel 112. Further, expansion apparatuses 165 and 166 have wedges 20, which comprise first and second, or upper and lower wedges 173 and 174, respectively. Upper and lower wedges 173 and 174 are disposed about mandrel 112. Upper and lower wedges 173 and 174 are in contact with upper and lower expansion wedges 171 and 172, respectively, in accordance with the above discussion.

Sealing element 176, which is an expandable sealing element 176, is disposed about mandrel 112 and has first and second extrusion limiters 177 and 178 fixed thereto at first and second ends 179 and 180 thereof. The embodiment illustrates a single sealing element; however, a multiple piece packer configuration can be used. First and second extrusion limiters 177 and 178 are abutted by second end 30 of wedges 173 and 174, respectively.

In operation, the downhole tool 100 in FIG. 5, in run-in configuration or unset position is lowered into (run-in) the well by means of a work string of tubing sections or coupled tubing attached to the upper end 144 of head portion 140. A setting tool can be part of the work string. The downhole tool 100 in its unset position fits through first casing 106, which has the smaller diameter of the two casings 106 and 110. Downhole tool 100 is then positioned in second casing 110. When downhole tool 100 is at a desired depth in the well, the setting tool is actuated and it drives spacer ring 164 from its run-in configuration to the set position shown in FIG. 6. Spacer ring 164 as well as other components, such as wedge 20, can be held in place during run-in by shear pins. The axial pressure provided by the setting tool is sufficient to shear the shear pins to allow the components held by the shear pins to move to their set position.

As the distance between spacer ring 164 and the mule shoe 126 is decreased, each expansion apparatus 10 is longitudinally compressed. With sufficient compression and sufficient resultant relative movement among wedge 20, expansion wedge 40 and slip ring 80, the connections between the wedge segments 44 are sheared and the connections between the slip segments 82 are sheared thus separating the wedge segments 44 from each other and the slip segments 82 from each other. With subsequent relative movement among wedge 20, expansion wedge 40 and slip ring 80, wedge 20 is slid under wedge segments 44 driving them radially outward to their expanded configuration. Similarly, first the inclined portion 46 of collar piece 42 is slid under slip segments 82 driving them radially outward and then wedge segments 44 are slid under slip segments 82 driving them radially outward and to their expanded configuration so that buttons 169, or other suitable gripping elements, grippingly engages second casing 110. With still further sufficient reduction in distance between spacer ring 164 and mule shoe 126, the sealing element 176 seals against the second casing 110. FIG. 6 shows the expansion apparatus 10 in such an expanded configuration with the slip segments 82 fully driven over wedge segments 44. FIG. 6 further shows the sealing element 176 and buttons 169 engaged with second casing 110.

In the above description terms such as up, down, lower, upper, upward, downward and similar have been used to describe the placement or movement of elements. It should be understood that these terms are used in accordance with the typical orientation of a casing string; however, the invention is not limited to use in such an orientation but is applicable to use with other orientations. Also, it will be seen that the floating apparatus of the present invention and method of use of such an apparatus are well adapted to carry out the ends and advantages mentioned as well as those inherent therein. While the presently preferred embodiment of the invention has been shown for the purposes of this disclosure, numerous changes in the arrangement and construction of parts may be made by those skilled in the art. All such changes are encompassed within the scope and spirit of the dependent claims.

What is claimed is:

1. An expansion apparatus for a downhole tool, comprising:

a wedge having an inclined outer wall wherein said wedge is coaxial to a central axis;

an expandable wedge comprising a collar piece and a plurality of wedge segments, wherein the collar piece comprises a plurality of openings with each opening housing one of said wedge segments, wherein each of said wedge segments comprise an inner surface and an inclined outer surface, said wedge segment being disposed about said central axis, wherein said expandable wedge has an unset position where said wedge segments are positioned at least partially internally to the collar piece, said expandable wedge has a set position where said wedge segments are moved radially outward relative to said collar piece through said plurality of openings in said collar piece, and said expandable wedge is moved from said unset position to said set position by interaction with said wedge;

a plurality of slip segments disposed about said central axis and expandable radially outward by interaction with said expandable wedge.

2. The expansion apparatus of claim 1 wherein said inclined outer wall is a frustoconical wall, said wedge being configured such that said frustoconical wall is coaxial to said central axis.

3. The expansion apparatus of claim 1 wherein said wedge segments move radially outward when there is axial movement of said wedge relative to said expandable wedge along said central axis such that said inner surface of said wedge segments is moved along said inclined outer wall of said wedge.

4. The expansion apparatus of claim 3 wherein each of said slip segments of said plurality of slip segments has an outer surface and an inner surface and each slip segment moves radially outward when there is axial movement of said slip segment relative to said wedge segments such that said inner surface of said slip segment is moved along said inclined outer surface of at least one of said wedge segments.

5. The expansion apparatus of claim 1 wherein said collar piece has an inclined portion and a plurality of axially extending members extending axially from a first end of said inclined portion and wherein said incline portion and said axially extending members define said openings such that said wedge segments are located between said axially extending members.

6. The expansion apparatus of claim 1 wherein said wedge segments are frangibly connected to each other.

7. The expansion apparatus of claim 6 wherein said wedge segments are frangibly connected by a retaining band disposed circumferentially about said inclined outer surface.

8. An expansion apparatus for a downhole tool, comprising:

a wedge having a frustoconical wall that is coaxial to a central axis;

an expandable wedge having:

a plurality of frangibly connected wedge segments, said wedge segments comprising an inner surface and an inclined outer surface, said wedge segments being disposed about said central axis wherein said wedge segments move radially outward when there is axial movement of said wedge relative to said expandable wedge along said central axis such that said inner surface of said wedge segments is moved along said frustoconical wall of said wedge; and a collar piece housing said wedge segments, said collar piece having an inclined portion and a plurality of axially extending members extending axially from a first end of said inclined portion and wherein said wedge segments are located between said axially extending members such that, prior to said axial movement of said wedge, said wedge segments are at least partially internal to said collar piece and such that said wedge segments move radially outward relative to said collar piece; and a plurality of frangibly connected slip segments disposed about said central axis wherein each of said slip segments of said plurality of slip segments has an outer surface and an inner surface and each slip segment moves radially outward when there is axial movement of said slip segment relative to said wedge segments such that said inner surface of said slip segment is moved along said inclined portion of said collar piece and said inclined outer surface of at least one of said wedge segments.

9. A downhole tool for use in a well comprising:

a mandrel;

a wedge disposed about said mandrel, said wedge being coaxial with said mandrel to a central axis;

an expandable wedge comprising a collar piece and a plurality of wedge segments, wherein the collar piece comprises one or more openings with each opening housing one of said wedge segments, wherein each of said wedge segments is disposed about said mandrel and, when said downhole tool moves from an unset position to a set position, said wedge segments expand radially outwardly relative to said collar piece through said one or more openings in said collar piece by interaction with said wedge, and wherein said wedge segments are positioned at least partially internally to the collar piece in the unset position; and a slip ring disposed about said mandrel and, when said downhole tool moves from an unset position to a set position, said slip ring expands radially outward by interaction with said expandable wedge so that said slip ring grippingly engages said well.

10. The downhole tool of claim 9 wherein said wedge has an inclined outer wall and said wedge is configured such that said inclined outer wall is coaxial to said central axis.

11. The downhole tool of claim 10 wherein said wedge segments have an inner surface and an outer surface and are frangibly attached to each other and, when said downhole tool moves from said unset position to said set position, said wedge segments separate and move radially outward by said inner surface of said wedge segments moving along said inclined outer wall of said wedge.

12. The downhole tool of claim 11 wherein said slip ring is comprised of a plurality of frangibly attached slip segments, each such slip segment having an outer surface and an inner surface and, when said downhole tool moves from said unset position to said set position, each slip segment moves radially outward by said inner surface of said slip segment, moving along said inclined outer surface of at least one of said wedge segments.

13. The downhole tool of claim 12 wherein said collar piece has an inclined portion and a plurality of axially extending members extending axially from a first end of said inclined portion and wherein said incline portion and said axially extending members define said one or more openings such that said wedge segments are located between said axially extending members and wherein, when said downhole tool moves from said unset position to said set position, each slip segment moves radially outward by said inner surface of said slip segment moving along said inclined portion of said collar piece and said inclined outer surface of at least one of said wedge segments.

14. The downhole tool of claim 13 further comprising a packer element disposed about said mandrel, said packer element engaging said well when said downhole tool moves from said set position to said unset position.

15. A method of operating a wellbore servicing tool, comprising:

longitudinally compressing an expansion device along a central axis such that there is relative axial movement of a wedge, an expandable wedge and a slip ring towards each other, wherein the expandable wedge comprises a collar piece and a plurality of wedge segments, wherein the collar piece has a plurality of openings with each opening housing one of said wedge segments and, prior to longitudinal compression of the expansion device, said wedge segments are positioned at least partially internally to the collar piece, and wherein the slip ring comprising a plurality of slip segments; and upon sufficient compression, expanding said plurality of wedge segments radially outward relative to said collar piece through said plurality of openings in said collar piece by interaction of said wedge with said plurality of wedge segments and expanding said plurality of slip segments radially outward by interaction of said slip ring with said plurality of wedge segments.

16. The method of claim 15 wherein said wedge segments move radially outward during said relative axial movement with an inner surface of said wedge segments moving along an inclined outer wall of said wedge.

17. The method of claim 16 wherein each slip segment moves radially outward during said relative axial movement by an inner surface of said slip segment moving along an inclined outer surface of at least one of said wedge segments.

18. The method of claim 17 wherein said collar piece has an inclined portion and a plurality of axially extending members extending axially from a first end of said inclined portion and wherein said incline portion and said axially extending members define said openings such that said wedge segments are located between said axially extending members and wherein, during said relative axial movement, each slip segment moves radially outward by said inner surface of said slip segment moving along said inclined portion of said collar piece and said inclined outer surface of at least one of said wedge segments.

* * * * *